US010943731B2

(12) United States Patent
Kuribayashi et al.

(10) Patent No.: US 10,943,731 B2
(45) **Date of Patent: *Mar. 9, 2021**

(54) METHOD FOR PRODUCING RARE-EARTH MAGNETS, AND RARE-EARTH-COMPOUND APPLICATION DEVICE

(71) Applicant: SHIN-ETSU CHEMICAL CO., LTD., Tokyo (JP)

(72) Inventors: Yukihiro Kuribayashi, Echizen (JP); Shogo Kamiya, Echizen (JP); Harukazu Maegawa, Echizen (JP); Shintaro Tanaka, Echizen (JP)

(73) Assignee: SHIN-ETSU CHEMICAL CO., LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/569,982

(22) PCT Filed: Apr. 18, 2016

(86) PCT No.: PCT/JP2016/062195
§ 371 (c)(1),
(2) Date: Oct. 27, 2017

(87) PCT Pub. No.: WO2016/175062
PCT Pub. Date: Nov. 3, 2016

(65) Prior Publication Data

US 2018/0158606 A1 Jun. 7, 2018

(30) Foreign Application Priority Data

Apr. 28, 2015 (JP) ..... JP2015-092007

(51) Int. Cl.
*H01F 41/02* (2006.01)
*B05D 1/18* (2006.01)
(Continued)

(52) U.S. Cl.
CPC ..... *H01F 41/0293* (2013.01); *B05D 1/18* (2013.01); *B05D 3/00* (2013.01); *B05D 7/00* (2013.01);
(Continued)

(58) Field of Classification Search
CPC ..... H01F 7/02; H01F 1/053; H01F 1/0536
(Continued)

(56) References Cited

U.S. PATENT DOCUMENTS 2,913,385 A * 11/1959 Satriana ..... C23C 24/08 204/488
7,559,996 B2 7/2009 Miyata et al.
(Continued)

FOREIGN PATENT DOCUMENTS

CN 100361239 C 1/2008
CN 102483980 A 5/2012
(Continued)

OTHER PUBLICATIONS

Japanese Office Action dated Apr. 3, 2018, issued in corresponding Japanese Application No. 2015-092007.
(Continued)

*Primary Examiner* — Tabassom Tadayyon Eslami
(74) *Attorney, Agent, or Firm* — Birch, Stewart, Kolasch & Birch, LLP

(57) ABSTRACT

When sintered magnet bodies 1 are held in a jig 2 having a rotational axis in the vertical direction, immersed in a slurry 41 to apply the slurry thereto, rotated in conjunction with the jig to remove the surplus slurry on the surface of each of the sintered magnet bodies by centrifugal force, and subsequently dried to cause the surfaces of the sintered magnet bodies to be coated with a powder, the slurry is applied while the sintered magnet bodies are held such that no portion of any of the outer surfaces forming the contours of the sintered
(Continued)

magnet bodies is orthogonal to the direction of the centrifugal force. As a result, the rare-earth-compound powder can be uniformly applied to the surfaces of the sintered magnet bodies.

7 Claims, 8 Drawing Sheets

(51) Int. Cl.

| | |
|---|---|
| ***B05D 3/00*** | (2006.01) |
| ***C22C 38/00*** | (2006.01) |
| ***B05D 7/00*** | (2006.01) |
| ***B22F 3/00*** | (2021.01) |
| ***H01F 1/057*** | (2006.01) |
| *B22F 3/24* | (2006.01) |
| *C21D 6/00* | (2006.01) |
| *C22C 33/02* | (2006.01) |
| *H01F 41/14* | (2006.01) |

(52) U.S. Cl.
CPC ..... *B22F 3/00* (2013.01); *C22C 38/00* (2013.01); *H01F 1/0577* (2013.01); *B22F 3/24* (2013.01); *B22F 2003/248* (2013.01); *B22F 2301/45* (2013.01); *C21D 6/00* (2013.01); *C22C 33/02* (2013.01); *H01F 41/14* (2013.01)

(58) Field of Classification Search
USPC ..... 427/127, 130, 131, 132, 512, 430.1, 209
See application file for complete search history.

(56) References Cited

U.S. PATENT DOCUMENTS

| | | | | |
|---|---|---|---|---|
| 8,377,233 | B2 | 2/2013 | Nakamura et al. | |
| 2001/0050046 | A1* | 12/2001 | Nishida | B65G 49/0459 118/416 |
| 2005/0233068 | A1 | 10/2005 | Yoshimura et al. | |
| 2008/0124567 | A1* | 5/2008 | Yoshimura | B05C 3/09 428/611 |
| 2008/0245442 | A1* | 10/2008 | Nakamura | B22F 9/023 148/101 |
| 2012/0139388 | A1 | 6/2012 | Iwasaki et al. | |
| 2013/0271248 | A1 | 10/2013 | Nagata et al. | |

FOREIGN PATENT DOCUMENTS

| | | | | |
|---|---|---|---|---|
| JP | 6-39327 | A | | 2/1994 |
| JP | 2002-120133 | A | | 4/2002 |
| JP | 2007-090224 | | * | 4/2004 |
| JP | 2005-109421 | A | | 4/2005 |
| JP | 2007-53351 | A | | 3/2007 |
| JP | 2007-90224 | A | | 4/2007 |
| JP | 4618390 | B1 | | 1/2011 |
| JP | 2011-129648 | A | | 6/2011 |
| JP | 2013-236071 | A | | 11/2013 |
| WO | WO 2004/051678 | A1 | | 6/2004 |
| WO | WO 2006/043348 | A1 | | 4/2006 |

OTHER PUBLICATIONS

Extended European Search Report, dated Nov. 7, 2018, for European Application No. 16786339.8.
International Search Report, issued in PCT/JP2016/062195, PCT/ISA/210, dated Jul. 19, 2016.
Chinese Office Action and Search Report, dated Apr. 30, 2019 for Chinese Application No. 201680024625.9, with an English machine translation of the Chinese Office Action.

* cited by examiner

METHOD FOR PRODUCING RARE-EARTH MAGNETS, AND RARE-EARTH-COMPOUND APPLICATION DEVICE

TECHNICAL FIELD

The present invention relates to a method for producing a rare-earth magnets by which rare-earth magnets excellent in magnetic properties can be efficiently obtained through uniform and efficient application of a rare-earth-compound powder in a process of applying a powder containing a rare-earth compound to sintered magnet bodies, followed by a heat treatment to cause a rare-earth element to be absorbed into the sintered magnet bodies and thereby to produce rare-earth permanent magnets, and relates also to a rare-earth-compound application device which can be favorably used in the method for producing the rare-earth magnets.

BACKGROUND ART

Rare-earth permanent magnets such as Nd—Fe—B based ones have been used more and more widely, because of their excellent magnetic properties. As a method for further enhancing the coercivity of the rare-earth magnets, conventionally, there has been known a method of applying a powder of a rare-earth compound to the surface of a sintered magnet body, followed by a heat treatment to cause a rare-earth element to be absorbed and diffused into the sintered magnet body and thereby to obtain a rare-earth permanent magnet (Patent Document 1: JP-A 2007-53351, Patent Document 2: WO 2006/043348). According to this method, it is possible to increase coercivity while suppressing a reduction in remanence.

However, this method yet leaves room for further improvement. Conventionally, the application of the rare-earth compound has generally been conducted by immersing a sintered magnet body in a slurry obtained by dispersing a powder containing the rare-earth compound in water or an organic solvent, or spraying the slurry to the sintered magnet body, thereby to apply the slurry to the sintered magnet body, followed by drying. In the immersion method and the spraying method, it is difficult to uniformly apply the slurry to the sintered magnet body, particularly, a sintered magnet body in the shape of a tetragonal plate or a tetragonal block, and variability would result in the thickness of the coating film. Further, since the denseness of the film is not high, an excess of coating amount is needed for causing the increase in coercivity to be enhanced to saturation.

Therefore, development of an application method by which a powder of a rare-earth compound can be applied uniformly and efficiently is desired. Note that as other prior arts considered to relate to the present invention, there can be mentioned JP-A 2011-129648 (Patent Document 3) and JP-A 2005-109421 (Patent Document 4).

PRIOR ART DOCUMENTS

Patent Documents

Patent Document 1: JP-A 2007-53351
Patent Document 2: WO 2006/043348
Patent Document 3: JP-A 2011-129648
Patent Document 4: JP-A 2005-109421

SUMMARY OF THE INVENTION

Problems to be Solved by the Invention

The present invention has been made in consideration of the above-mentioned circumstances. Accordingly, it is an object of the present invention to provide: a method for producing a rare-earth magnet by which it is possible to apply a powder uniformly and efficiently, to control a coating amount so as to form a dense coating film of the powder with good adhesion, and thereby to efficiently obtain a rare-earth magnet more excellent in magnetic properties, in a process of applying a slurry obtained by dispersing a powder containing at least one selected from an oxide, a fluoride, an oxyfluoride, a hydroxide or a hydride of $R^2$ ($R^2$ is at least one selected from rare-earth elements including Y and Sc) in a solvent to a sintered magnet body composed of a $R^1$—Fe—B composition ($R^1$ is at least one selected from rare-earth elements including Y and Sc), drying the slurry to coat a surface of the sintered magnet body with the powder, and heat treating the powder-coated sintered magnet body to cause the $R^2$ to be absorbed into the sintered magnet body and to thereby produce a rare-earth permanent magnet; and a rare-earth-compound application device which can be suitably used in the method for producing the rare-earth magnet.

Means for Solving the Problems

In order to achieve the above object, the present invention provides methods for producing a rare-earth magnet of the following paragraphs [1] to [7].

[1] A method for producing a rare-earth magnet, in a process of applying a slurry obtained by dispersing a powder containing at least one selected from an oxide, a fluoride, an oxyfluoride, a hydroxide or a hydride of $R^2$ ($R^2$ is at least one selected from rare-earth elements including Y and Sc) in a solvent to a sintered magnet body composed of a $R^1$—Fe—B composition ($R^1$ is at least one selected from rare-earth elements including Y and Sc), drying the slurry to cause a surface of the sintered magnet body to be coated with the powder, and heat treating the powder-coated sintered magnet body to cause the $R^2$ to be absorbed into the sintered magnet body and thereby to produce a rare-earth permanent magnet, the method including:

holding a plurality of the sintered magnet bodies by a rotatable jig;

immersing the sintered magnet bodies in the slurry obtained by dispersing the powder to coat each of the sintered magnet bodies with the slurry;

drawing the slurry-coated sintered magnet bodies up from the slurry and rotating the sintered magnet bodies together with the jig to remove surplus slurry on the surface of each of the sintered magnet bodies by a centrifugal force; and drying the slurry-coated sintered magnet bodies to coat the surfaces of the sintered magnet bodies with the powder, in which the slurry is applied while the sintered magnet bodies are disposed around a rotational axis of the jig and are inclined such that no part of any of outer surfaces constituting shapes of the sintered magnet bodies is orthogonal to the direction of the centrifugal force.

[2] The method for producing the rare-earth magnet of the above paragraph [1], in which the sintered magnet bodies are in a shape of a tetragonal plate or a tetragonal block, and each of the sintered magnet bodies is held by the jig in a state in which the sintered magnet body is erect with its thickness direction set horizontal and with its length direction or width direction inclined at an angle of more than 0° and less than 45° from the direction of the centrifugal force.

[3] The method for producing the rare-earth magnet of the above paragraph [1] or [2], in which the application process of immersing the sintered magnet bodies in the slurry, removing the surplus slurry and drying the slurry-coated sintered magnet bodies is repeated multiple times.

[4] The method for producing the rare-earth magnet of any one of the above paragraphs [1] to [3], in which the jig is rotated normally and reversely at a low speed of 5 to 20 rpm in a state in which the sintered magnet bodies are immersed in the slurry, thereby to apply the slurry to the sintered magnet bodies.

[5] The method for producing the rare-earth magnet of any one of the above paragraphs [1] to [4], in which the jig is drawn up from the slurry and rotated normally and reversely at a high speed of 170 to 550 rpm, thereby to remove the surplus slurry present on the surfaces of the sintered magnet bodies.

[6] The method for producing the rare-earth magnet of any one of the above paragraphs [1] to [5], in which the sintered magnet body coated with the powder is heat treated in vacuum or an inert gas at temperature of up to sintering temperature of the sintered magnet body.

[7] The method for producing the rare-earth magnet of any one of the above paragraphs [1] to [6], in which after the heat treatment, the sintered magnet body coated with the powder is subjected further to an ageing treatment at low temperature.

In addition, in order to achieve the above object, the present invention provides rare-earth-compound application devices of the following paragraphs [8] to [14].

[8] A rare-earth-compound application device for applying a slurry to a sintered magnet body, the slurry obtained by dispersing a powder containing at least one selected from an oxide, a fluoride, an oxyfluoride, a hydroxide or a hydride of $R^2$ ($R^2$ is at least one selected from rare-earth elements including Y and Sc) in a solvent, the sintered magnet body composed of a $R^1$—Fe—B composition ($R^1$ is at least one selected from rare-earth elements including Y and Sc), in a process of applying the slurry to the sintered magnet body, drying the slurry to coat a surface of the sintered magnet body with the powder, and heat treating the powder-coated sintered magnet body to cause the $R^2$ to be absorbed into the sintered magnet body and thereby to produce a rare-earth permanent magnet, the rare-earth-compound application device including:

a jig for holding a plurality of the sintered magnet bodies around a rotational center in an inclined state such that no part of any of outer surfaces constituting shapes of the sintered magnet bodies is orthogonal to the direction of the centrifugal force;

rotating means for rotating the jig about a rotational axis passing through the rotational center;

a slurry tank that contains the slurry obtained by dispersing the powder in the solvent, the sintered magnet bodies being immersed in the slurry to be coated with the slurry; and lifting means for immersing the sintered magnet bodies held by the jig in the slurry in the slurry tank and drawing up the sintered magnet bodies, in which the slurry is contained in the slurry tank, the sintered magnet bodies are held by the jig, the sintered magnet bodies held by the jig are immersed in the slurry in the slurry tank to apply the slurry to surfaces of the sintered magnet bodies by the lifting means, and the sintered magnet bodies are drawn up from the slurry by the lifting means and rotated by the rotating means, to remove surplus slurry on the surfaces of the sintered magnet bodies by the centrifugal force.

[9] The rare-earth-compound application device of the above paragraph [8], in which the sintered magnet bodies are in a shape of a tetragonal plate or a tetragonal block, and the jig holds each of the sintered magnet bodies in a state in which the sintered magnet body is erect with its thickness direction set horizontal and with its length direction or width direction inclined at an angle of more than 0° and less than 45° from the direction of the centrifugal force.

[10] The rare-earth-compound application device of the above paragraph [8] or [9], in which the slurry is contained in the slurry tank up to an intermediate height of the slurry tank, the sintered magnet bodies are drawn up from the slurry, held at an upper portion inside the slurry tank and rotated, thereby to perform surplus slurry removal in the slurry tank.

[11] The rare-earth-compound application device of any one of the above paragraphs [8] to [10], in which the jig includes a basket which can be attached to and detached from the rotating means, and an object holding body which is disposed at a bottom portion inside the basket and by which the sintered magnet bodies are disposed and held around the rotational center.

[12] The rare-earth-compound application device of the above paragraph [7], in which the object holding body includes a plurality of arcuate racks each formed with a plurality of holding pockets for holding the sintered magnet bodies, the racks being combined and disposed in a circular pattern around the rotational center.

[13] The rare-earth-compound application device of any one of the above paragraphs [8] to [12], in which the rotating means is for rotating the jig normally and reversely at a controllable speed, and is configured to rotate the jig normally and reversely at a low speed of 5 to 20 rpm in a state in which the sintered magnet bodies are immersed in the slurry, thereby to apply the slurry to the sintered magnet bodies.

[14] The rare-earth-compound application device of any one of the above paragraphs [8] to [13], in which the rotating means is for rotating the jig normally and reversely at a controllable speed, and is configured to rotate the jig drawn out from the slurry, normally and reversely at a high speed of 170 to 550 rpm, thereby to remove the surplus slurry present on the surfaces of the sintered magnet bodies.

Specifically, in the producing method and the application device of the present invention, when sintered magnet bodies held by a rotatable jig are immersed in a slurry obtained by dispersing a rare-earth-compound powder, are drawn up from the slurry and are rotated to remove the surplus slurry, thereby applying the slurry to the surfaces of the sintered magnet bodies, the sintered magnet bodies are held and rotated in an inclined state such that none of the flat surfaces thereof is orthogonal to the direction of the centrifugal force, to remove the surplus slurry. As a result, the centrifugal force is exerted on the surplus slurry on the surfaces of the sintered magnet bodies in a state in which all the surfaces are inclined at a predetermined angle without being faced perpendicularly to the centrifugal force, so that the surplus slurry on the surfaces can be removed without stagnation, and the slurry can be uniformly applied.

For example, where the sintered magnet body is in the shape of a tetragonal plate or a tetragonal block, as in the above paragraphs [2] and [9], the sintered magnet body is held in an erect state with its thickness direction set horizontal and with its length direction or width direction inclined at an angle of more than 0° and less than 45° from the direction of the centrifugal force, and is rotated, to remove the surplus slurry. As a result, none of the surfaces of the sintered magnet body in the shape of a tetragonal plate or a tetragonal block, namely, a hexahedron, is orthogonal to the direction of the centrifugal force, and the centrifugal force is exerted on the surplus slurry on the surfaces of the sintered magnet body in a state in which all the six surfaces of the sintered magnet body are inclined at a preset angle without being faced perpendicularly to the centrifugal force, whereby the surplus slurry can be removed without stagnation, and the slurry can be uniformly applied.

Advantageous Effects of the Invention

According to the present invention, the slurry obtained by dispersing the rare-earth-compound powder can be uniformly applied to the sintered magnet bodies in the shape of a tetragonal plate or a tetragonal block or to sintered magnet bodies having various shapes, and, by drying the applied slurry, a uniform and dense coating film of the powder of the rare-earth magnet can be formed reliably. Therefore, the coating amount can be controlled accurately, and a uniform and dense coating film of the rare-earth-compound powder can be efficiently formed on the surfaces of the sintered magnet bodies.

Consequently, according to the producing method and the application device of the present invention, the powder of the rare-earth compound can thus be uniformly and densely applied to the surface of the sintered magnet body, and, therefore, it is possible, by heat treating the powder-coated sintered magnet body, to efficiently produce a rare-earth magnet which is excellent in magnetic properties and favorably increased in coercivity.

BRIEF DESCRIPTION OF THE DIAGRAMS

FIGS. 1 to 5 are illustrations of a rare-earth-compound powder application step in a production method of the present invention that is conducted using an application device according to an embodiment of the present invention, in which FIG. 1 is an illustration of a step of setting sintered magnet bodies on a jig and further setting the jig to rotating means.

FIGS. 1 to 5 are illustrations of the rare-earth-compound powder application step in the production method of the present invention that is conducted using the application device according to the embodiment of the present invention, in which FIG. 2 is an illustration of a step of immersing the jig with the sintered magnet bodies held thereon in a slurry in a slurry tank.

FIGS. 1 to 5 are illustrations of the rare-earth-compound powder application step in the production method of the present invention that is conducted using the application device according to the embodiment of the present invention, in which FIG. 3 is an illustration of a step of drawing up the sintered magnet bodies from the slurry and rotating the sintered magnet bodies to remove surplus slurry.

Figure 2:
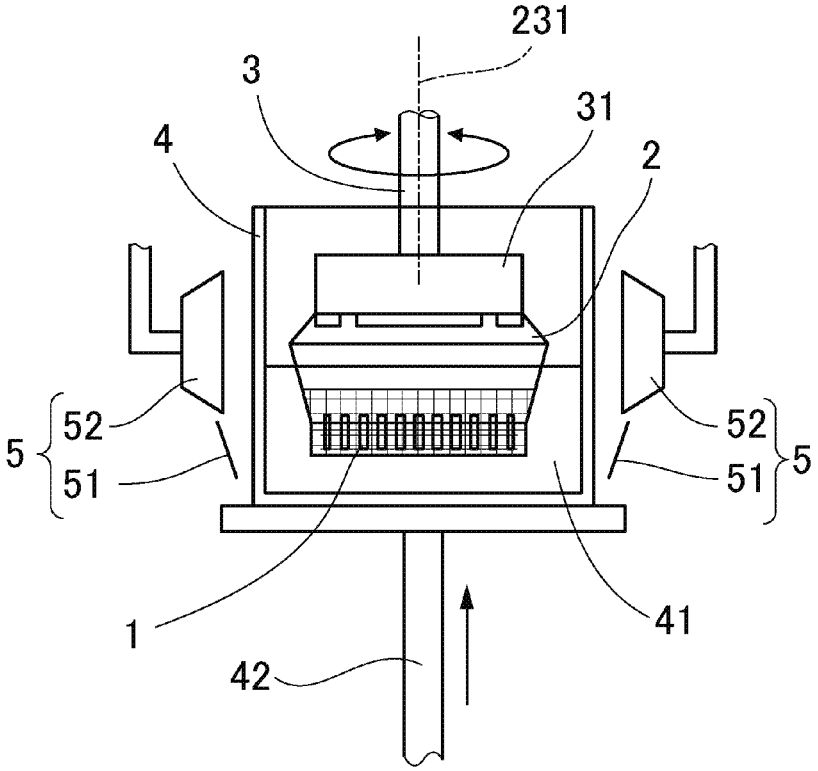
Figure 3:
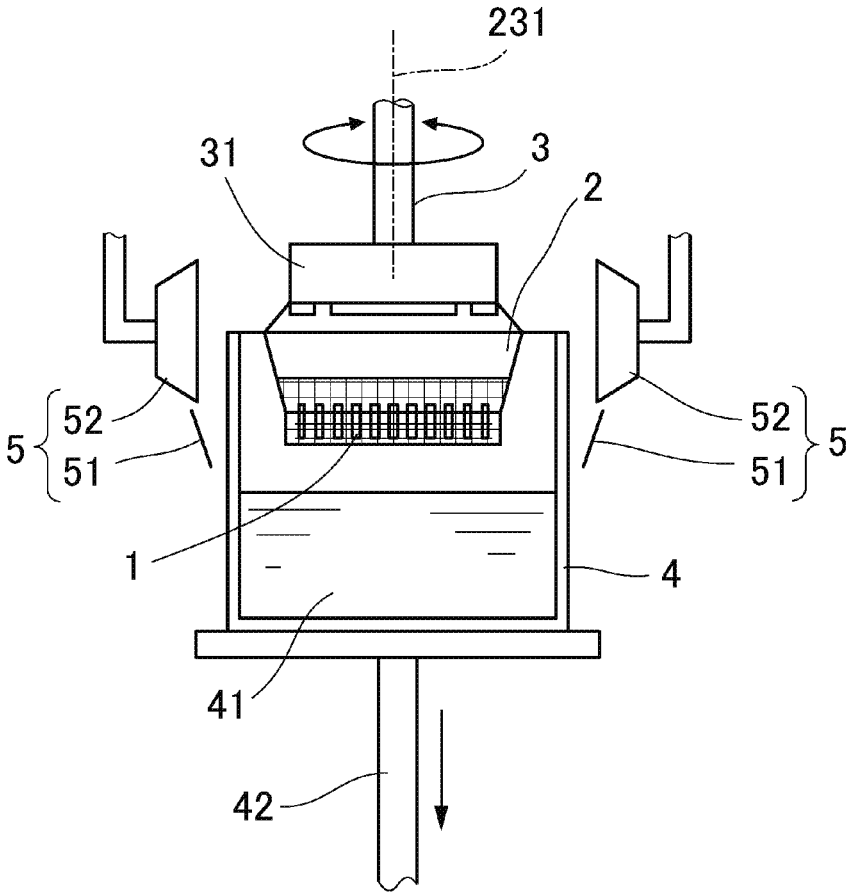
Figure 4:
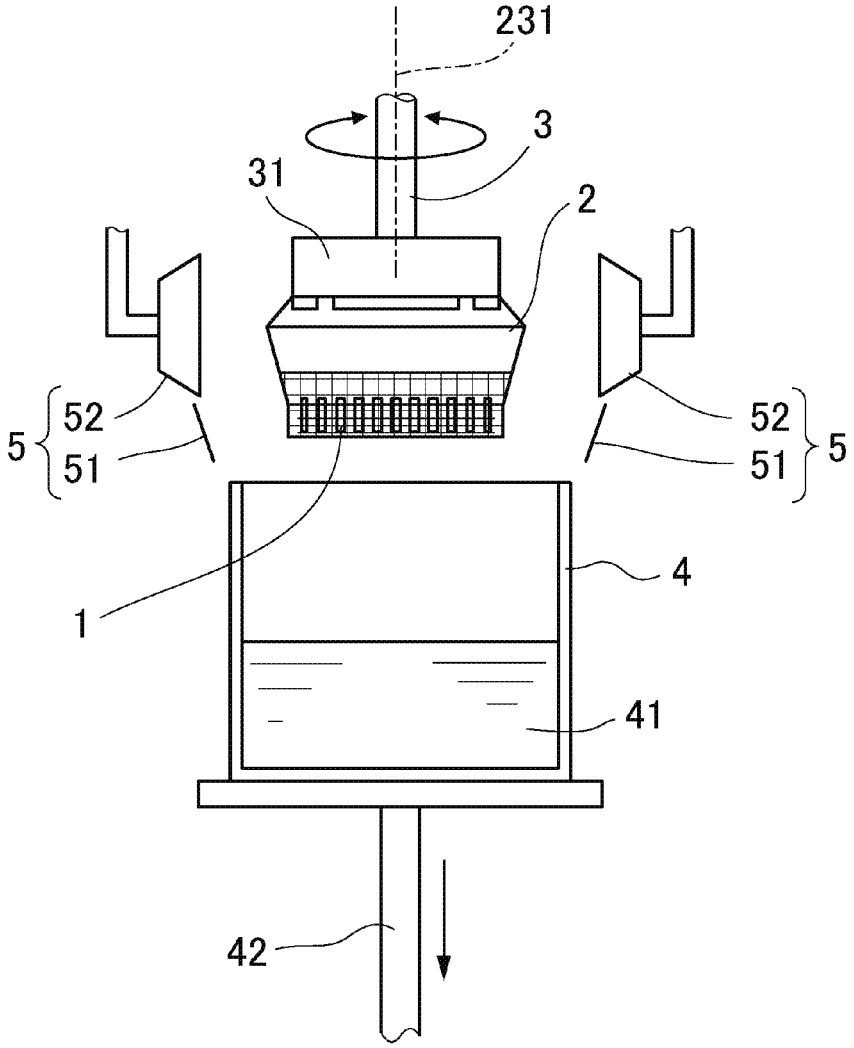

FIGS. 1 to 5 are illustrations of the rare-earth-compound powder application step in the production method of the present invention that is conducted using the application device according to the embodiment of the present invention, in which FIG. 4 is an illustration of a step of drying the sintered magnet bodies to remove a solvent in the slurry and coat the sintered magnet bodies with a rare-earth-compound powder.

Figure 5:
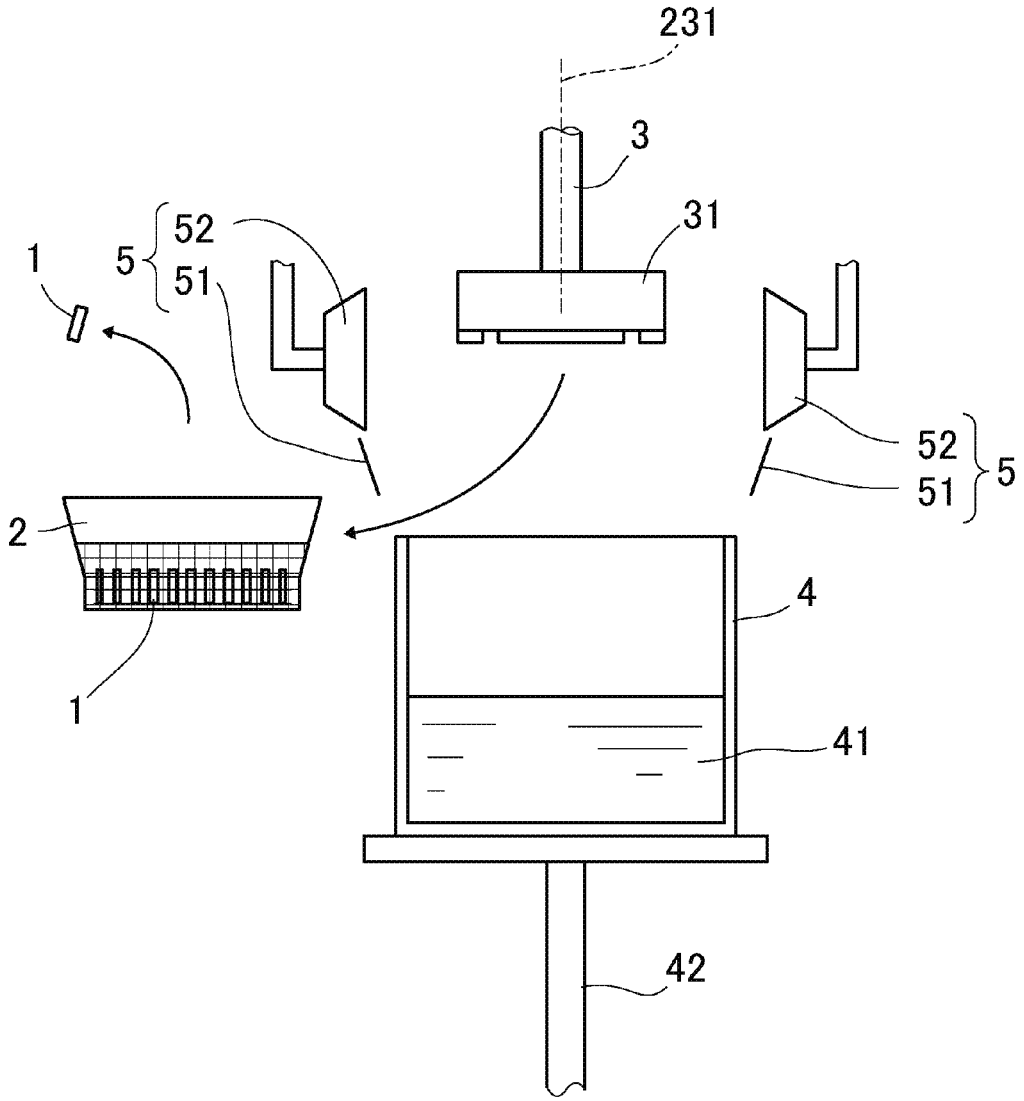

FIGS. 1 to 5 are illustrations of the rare-earth-compound powder application step in the production method of the present invention that is conducted using the application device according to the embodiment of the present invention, in which FIG. 5 is an illustration of a step of detaching the jig from the rotating means and recovering the sintered magnet bodies with the rare-earth-compound powder applied to surfaces thereof.

Figure 6:
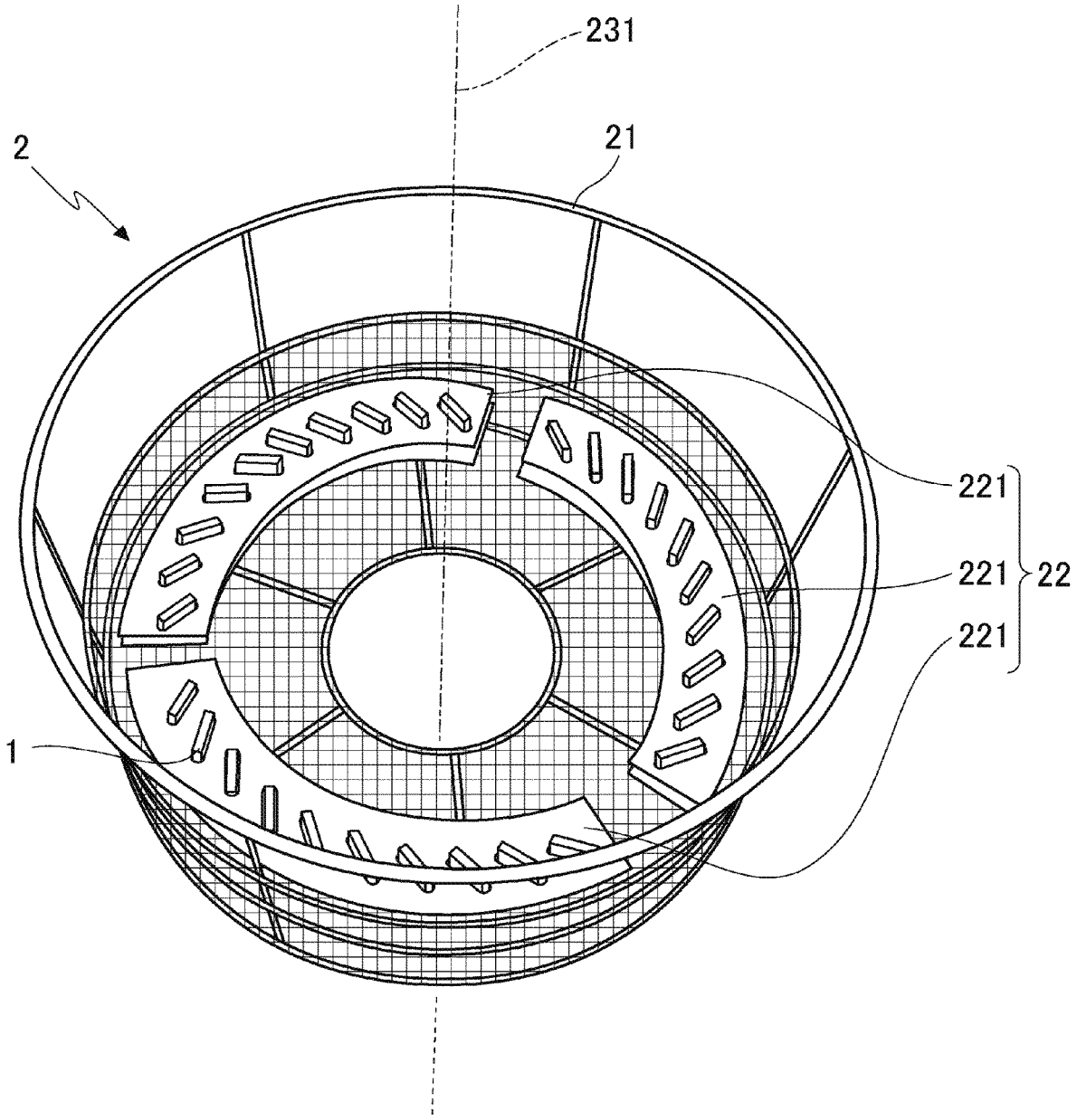

FIG. 6 is a schematic perspective view of the jig constituting the application device.

Figure 7:
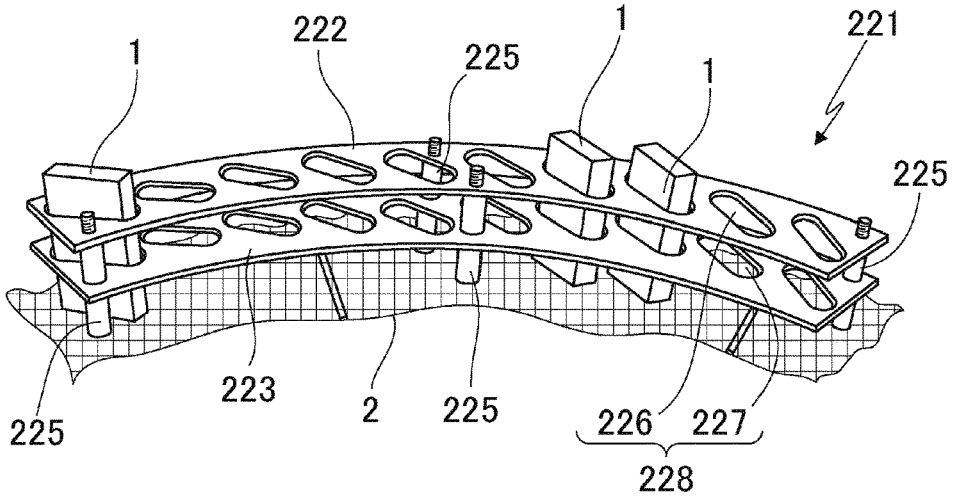

FIG. 7 is a schematic perspective view of an arcuate rack constituting an object holding body of the jig.

Figure 8:
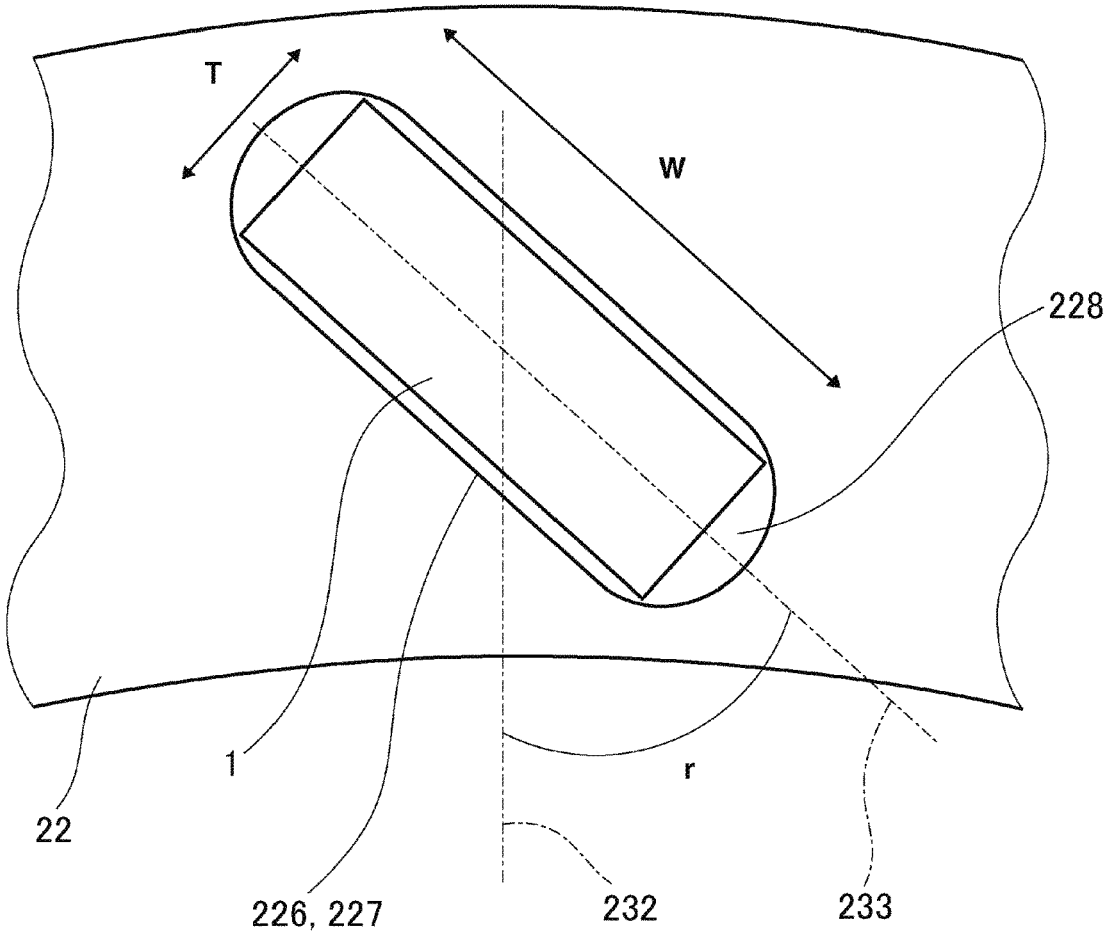

FIG. 8 is an illustration of the relation between the disposing direction of the sintered magnet bodies in the present invention and the direction of a centrifugal force.

Figure 9:
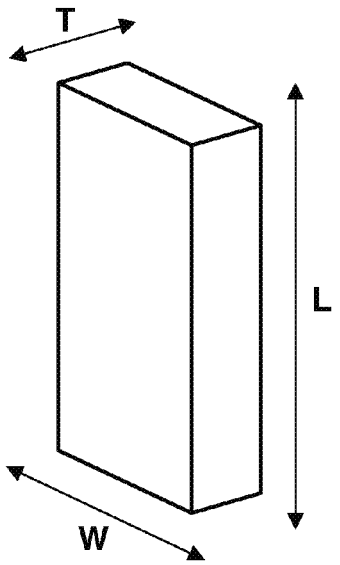

FIG. 9 is a schematic perspective view of the sintered magnet body as an object to be treated in the present invention.

Figure 10:
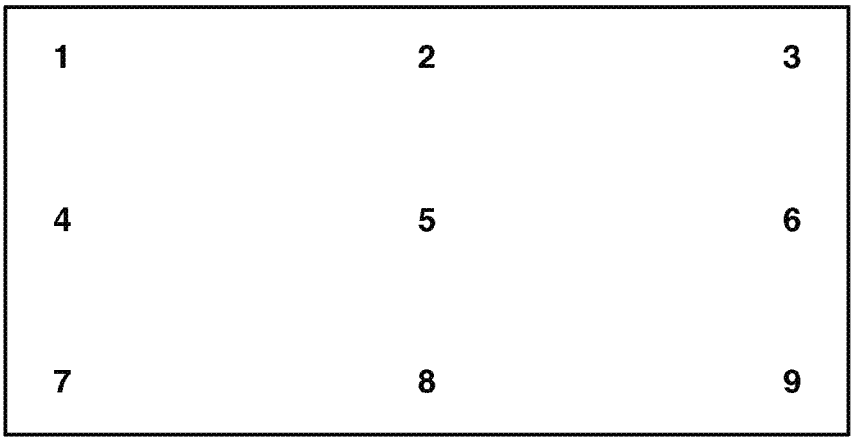

FIG. 10 is an illustration of a measuring position for the rare-earth magnet in Examples.

EMBODIMENT FOR CARRYING OUT THE INVENTION

As above-mentioned, the method of producing a rare-earth magnet of the present invention includes applying a slurry obtained by dispersing a powder containing at least one selected from an oxide, a fluoride, an oxyfluoride, a hydroxide or a hydride of $R^2$ ($R^2$ is at least one selected from rare-earth elements including Y and Sc) in a solvent to a sintered magnet body composed of a $R^1$—Fe—B composition ($R^1$ is at least one selected from rare-earth elements including Y and Sc), drying the slurry to coat a surface of the sintered magnet body with the powder, and heat treating the powder-coated sintered magnet body to cause the $R^2$ to be absorbed into the sintered magnet body and to thereby produce a rare-earth permanent magnet.

As the above-mentioned $R^1$—Fe—B sintered magnet body, those which are obtained by a known method can be used. For example, the $R^1$—Fe—B sintered magnet body can be obtained by subjecting a mother alloy or alloys containing $R^1$, Fe and B to milling, pulverization, forming, and sintering by usual methods. Note that as above-mentioned, $R^1$ is at least one selected from rare-earth elements including Y and Sc, and specific examples thereof include Y, Sc, La, Ce, Pr, Nd, Sm, Eu, Gd, Tb, Dy, Ho, Er, Yb and Lu.

In the present invention, the $R^1$—Fe—B sintered magnet body is formed into a predetermined shape by grinding as required, and served to the following powder application step. In this case, the shape of the sintered magnet body in the present invention is not limited. Not only the general shapes such as the shape of a tetragonal plate or a tetragonal block but also various shapes such as a semicircular shape and a roofing tile-like shape can be adopted, but a sintered magnet body in the shape of a tetragonal plate or a tetragonal block is particularly preferably used. For example, as depicted in FIG. 9, the sintered magnet body can be a sintered magnet body in the shape of a hexahedron having a thickness direction T, a length direction L and a width direction W orthogonal to one another.

In the method for producing a rare-earth magnet of the present invention, a powder containing at least one selected from an oxide, a fluoride, an oxyfluoride, a hydroxide and a hydride of $R^2$ is applied to a surface of the sintered magnet body, and the powder-coated sintered magnet body is heat treated to cause the at least one to be absorbed and diffused (boundary diffusion) into the sintered magnet body to obtain a rare-earth magnet.

As above-mentioned, the $R^2$ is at least one selected from rare-earth elements including Y and Sc, and, like the above-mentioned $R^1$, specific examples of the $R^2$ include Y, Sc, La, Ce, Pr, Nd, Sm, Eu, Gd, Tb, Dy, Ho, Er, Yb and Lu. In this case, though not particularly limited, it is preferable that one or more of the $R^2$ contain Dy or Tb in a total concentration of at least 10 at %, more preferably at least 20 at %, and particularly at least 40 at %. It is more preferable, from the viewpoint of the object of the present invention, that Dy and/or Tb is thus contained in the $R^2$ in a total concentration of at least 10 at %, and the total concentration of Nd and Pr in the $R^2$ is lower than the total concentration of Nd and Pr in the $R^1$.

The application of the powder in the present invention is conducted by preparing a slurry containing the powder dispersed in a solvent, applying the slurry to the surface of the sintered magnet body and drying the slurry. In this case, the particle diameter of the powder is not particularly limited, but can be a particle size generally adopted for a rare-earth-compound powder for use in absorption and diffusion (boundary diffusion); specifically, an average particle diameter is preferably up to 100 μm, more preferably up to 10 μm. While the lower limit is not particularly restricted, it is preferably at least 1 nm. This average particle diameter can be obtained as mass average value $D_{50}$ (namely, the particle diameter or median diameter at a cumulative mass of 50%) by use of a particle size distribution measuring apparatus based on a laser diffraction method, for example. Note that the solvent for dispersing the powder therein may be water or an organic solvent. The organic solvent is not particularly restricted, and examples thereof include ethanol, acetone, methanol, and isopropyl alcohol, among which ethanol is preferably used.

The amount of the powder dispersed in the slurry is not particularly limited. In the present invention, for favorable and efficient coating with the powder, the dispersion amount in the slurry in terms of mass fraction is preferably at least 1%, particularly preferably at least 10%, and further preferably at least 20%. Note that too large a dispersion amount leads to an inconvenient situation such as a situation in which a uniform dispersion cannot be obtained, and, therefore, the upper limit of the mass fraction is preferably up to 70%, particularly preferably up to 60%, and further preferably up to 50%.

In the present invention, as a method for applying the slurry to the sintered magnet body and drying the slurry to coat the surface of the sintered magnet body with the powder, there is adopted a method in which a plurality of the sintered magnet bodies are held side by side by a rotatable jig, are immersed in the slurry obtained by dispersing the powder to apply the slurry to each of the sintered magnet bodies, are then drawn up from the slurry and rotated together with the jig to remove the surplus slurry on the surface of each of the sintered magnet bodies by a centrifugal force, and are dried to coat the surfaces of the sintered magnet bodies with the powder. In that case, in the present invention, the slurry is applied in a state in which the sintered magnet bodies are disposed around a rotational axis of the jig having the rotational axis in the vertical direction, and the sintered magnet bodies are held in an inclined state such that none of the flat surfaces thereof is orthogonal to the direction of the centrifugal force. Specifically, the application of the powder can be carried out using an application device depicted in FIGS. 1 to 5.

Specifically, FIGS. 1 to 5 are schematic views depicting a rare-earth-compound application device according to an embodiment of the present invention. The application device is for holding a plurality of the sintered magnet bodies 1 are held by a jig 2 in the state of being aligned in a circular pattern (FIG. 1), immersing the sintered magnet bodies 1 in the slurry 41 to apply the slurry 41 to each of the sintered magnet bodies 1 (FIG. 2), drawing up the sintered magnet bodies 1 from the slurry 41 and rotating the sintered magnet bodies 1 together with the jig 2 to remove the surplus slurry present on the surface of each of the sintered magnet bodies 1 by a centrifugal force (FIG. 3), and drying the sintered magnet bodies 1 (FIG. 4), to coat the surfaces of the sintered magnet bodies 1 with the powder, after which the powder-coated sintered magnet bodies 1 are recovered from the jig 2 (FIG. 5).

As depicted in FIG. 6, the above-mentioned jig 2 is composed of a basket 21 formed from metallic wire of stainless steel or the like, and a circular object holding body 22 disposed at a bottom portion of the basket 21. The basket 21 is a hollow cylindrical basket-shaped body in which a plurality (in the figure, five) of ring-shaped frames formed from metallic wire are connected concentrically, with metallic net of stainless steel being arranged over the range of a bottom portion to an intermediate portion in the height direction of a peripheral wall, exclusive of a predetermined range in the center of the bottom portion.

The object holding body 22 has a plurality (in the figure, three) of arcuate racks 221 combined and disposed in a circular pattern at a bottom portion inside the basket 21. As depicted in FIG. 7, each of the racks 221 has two arcuately curved sheets 222 and 223 of stainless steel or the like which are disposed vertically overlappingly while spaced by a predetermined spacing and are interconnected by four props 225, with a lower end portion of each of the props 225 protruding downward from a lower surface of the lower-side sheet 223 to form a leg portion. The upper-stage sheet 222 and the intermediate-stage sheet 223 constituting the rack 221 are each formed with a plurality (in this figure, ten) of substantially elongated elliptic through-holes 226 and 227 which are aligned in a row and through which the sintered magnet bodies 1 can be passed. The through-holes 226 in the upper-stage sheet 222 and the through-holes 227 in the lower-stage sheet 223 are formed at vertically aligned positions, and a pair of the upper-stage and lower-stage through-holes 226 and 227 constitute a holding pocket 228 in which to hold the sintered magnet body 1. Besides, as depicted in FIG. 7, the sintered magnet body 1 inserted in the holding pocket 228 is supported by the holding pocket 228 in the state of being placed on the bottom wall of the basket 21, and is held to be erect with its thickness direction T (see FIG. 9) set horizontal.

The through-holes 226 and 227 constituting the holding pocket 228 are each preferably formed so that only four corners of the sintered magnet body 1 inserted therein make contact with both end curved portions thereof, as depicted in FIG. 8. This ensures that the slurry 41 flows reliably into the gaps between the surfaces of the sintered magnet body 1 and the edges of the through-holes 226 and 227, so that the whole surface of the sintered magnet body 1 can be reliably coated with the slurry 41.

As above-mentioned, a plurality (in the figure, three) of the racks 221 are disposed in a circular pattern and are placed on the metallic net at the bottom surface inside the basket 21 in a state in which each rack 221 is in contact with the metallic net at the circumferential wall surface of the basket 21, whereby the circular ring-shaped object holding body 22 is configured.

The jig 2 is fixed to a chuck section 31 of rotating means 3 which will be described later, and is rotated about a rotational axis 231 (in this example, a rotational axis along the vertical direction). The object holding body 22 is in the state of being disposed in a circular form around the rotational axis 231, and the plurality of sintered magnet bodies 1 held in the holding pocket 228 of the object holding body 22 are in the state of being disposed in a circular pattern around the center of rotation by the rotational axis 231.

Here, the holding pocket 228 is formed in the substantially elongate elliptic shape, as above-mentioned. As depicted in FIG. 8, the holding pocket 228 is formed along a direction 233 inclined at a predetermined angle r relative to a direction 232 of the centrifugal force with the rotational axis 231 as a center. Each sintered magnet body 1 held in the holding pocket 228 is held in the state of being erect with its thickness direction T set horizontal and with its width direction W inclined at a predetermined angle r from the direction 232 of the centrifugal force. Note that while an example in which the sintered magnet body 1 is held to be erect with its length direction L (see FIG. 9) set vertical has been depicted in this example, the sintered magnet body 1 may be held to be erect with its width direction W (see FIG. 9) set vertical in some cases; in that case, the sintered magnet body 1 is held with its length direction L inclined at a predetermined angle r from the direction 232 of the centrifugal force.

In addition, the sintered magnet body 1 is not limited to the one in the shape of the tetragonal plate or the tetragonal block as depicted in FIG. 9, and two or three of the dimensions including the thickness T, the width W and the length L thereof may be equal or substantially equal. In the case where two of the dimensions are equal or substantially equal, the direction of the smaller dimension may be the thickness direction T, and either of the other directions may be the width W or the length L. In the case where three of the dimensions are equal or substantially equal, the thickness T, the width W or the length L may be in any of the directions.

The inclination angle r is appropriately set according to the shape and size of the sintered magnet body 1 and rotational speed, and is not particularly limited. Normally, the inclination angle r is preferably set appropriately in the range of more than 0° and less than 45°, more preferably in the range of 5° to 40°, and further preferably in the range of 10° to 30°. Note that in the case where the inclination angle r is 0° or in the case where the inclination angle r exceeds 45°, the uniformity of coating amount may be lowered, or the denseness of the coating film may be partially lowered. In addition, the sintered magnet body 1 may be in other shape than the shape of the tetragonal plate or the tetragonal block; for example, various shapes such as a semicircular shape and a roofing tile-like shape can be adopted. In that case, it is sufficient that the sintered magnet body 1 is disposed in the state of being inclined at an appropriate angle such that no part of any of the outer surfaces constituting the shape of the sintered magnet body 1 is orthogonal to the direction 232 of the centrifugal force.

Here, since the basket 21 and the object holding body 22 are immersed in the slurry 41 together with the sintered magnet bodies 1 and coated with the slurry, if the metal such as stainless steel forming them has not been subjected to any treatment, the rare-earth-compound powder may be deposited on them to increase the wire diameter of the net or frames of the basket 21, or to change the dimensions of the holding pockets 228, possibly causing inconveniences in coating the sintered magnet bodies 1 with the slurry. Therefore, though not particularly limited, it is preferable to apply coating to the metal such as stainless steel forming the basket 21 and the object holding body 22 so that the slurry is hardly adhered to them. The kind of the coating is not particularly restricted, and coating with a fluororesin such as polytetrafluoroethylene (Teflon (registered trademark)) is preferred from the viewpoint of excellent abrasion resistance and water repellency.

Numeral 3 in FIGS. 1 to 5 denotes the rotating means having the chuck section 31 for holding the jig 2, and the jig 2 can be rotated normally and reversely at a controllable speed by the rotating means 3. Note that in this example, the jig 2 is rotated about the rotational axis 231 set along the vertical direction.

Numeral 4 in FIGS. 1 to 5 denotes a slurry tank, the slurry 41 is contained in the slurry tank 4, and the sintered magnet bodies 1 held by the jig 2 is immersed in the slurry 41, whereby the slurry 41 is applied to the surfaces of the sintered magnet bodies 1. The slurry tank 4 is held on a lift 42 (lifting means), and is vertically moved by the lift 42 (lifting means).

Numerals 51 in FIGS. 1 to 5 denote two heaters which are disposed at positions deviated by 180° from each other, in the surroundings of the jig 2 held by the chuck section 31 of the rotating means 3. The sintered magnet bodies 1 are dried by the heaters 51 to remove the solvent in the slurry applied to the sintered magnet bodies 1. On the upper side of the heaters 51 are disposed exhaust hoods 52, by which the evaporated solvent from the slurry is removed from the surroundings of the sintered magnet bodies 1, to achieve effective drying. The heaters 51 and the exhaust hoods 52 constitute drying means 5.

Here, the heaters 51 are for drying the sintered magnet bodies 1 held in the jig 2 by irradiating the sintered magnet bodies 1 with near infrared radiation of a wavelength of 0.8 to 5 μm. In the device of this example, three Twin Tube transparent silica glass-made short-wavelength infrared heater units (ZKB1500/200G, with cooling fan, output 1,500 W, heating length 200 mm) made by Heraeus K.K. are incorporated in each of the heaters 51.

This heater for irradiation with infrared radiation of a short wavelength of 0.8 to 5 μm is fast in build up, can start effective heating in one to two seconds, can heat up to 100° C. in ten seconds, and can complete drying in an extremely short time. Further, the heater can be configured inexpensively, and is advantageous in regard to power consumption, as compared to the case of performing induction heating. In addition, according to the radiational heating by irradiation with the near infrared radiation, the near infrared radiation is transmitted and absorbed into the inside of the slurry coating film, whereby heating and drying can be achieved. Therefore, generation of cracking due to drying being started from the outside of the coating film, as in the case of drying by blowing hot air from the exterior, for example, can be prevented as securely as possible, and a uniform and dense coating film of powder can be formed. Further, the heater tube for generating the near infrared radiation of a short wavelength is comparatively small in size, so that the application device can be made smaller in size.

Figure 1:
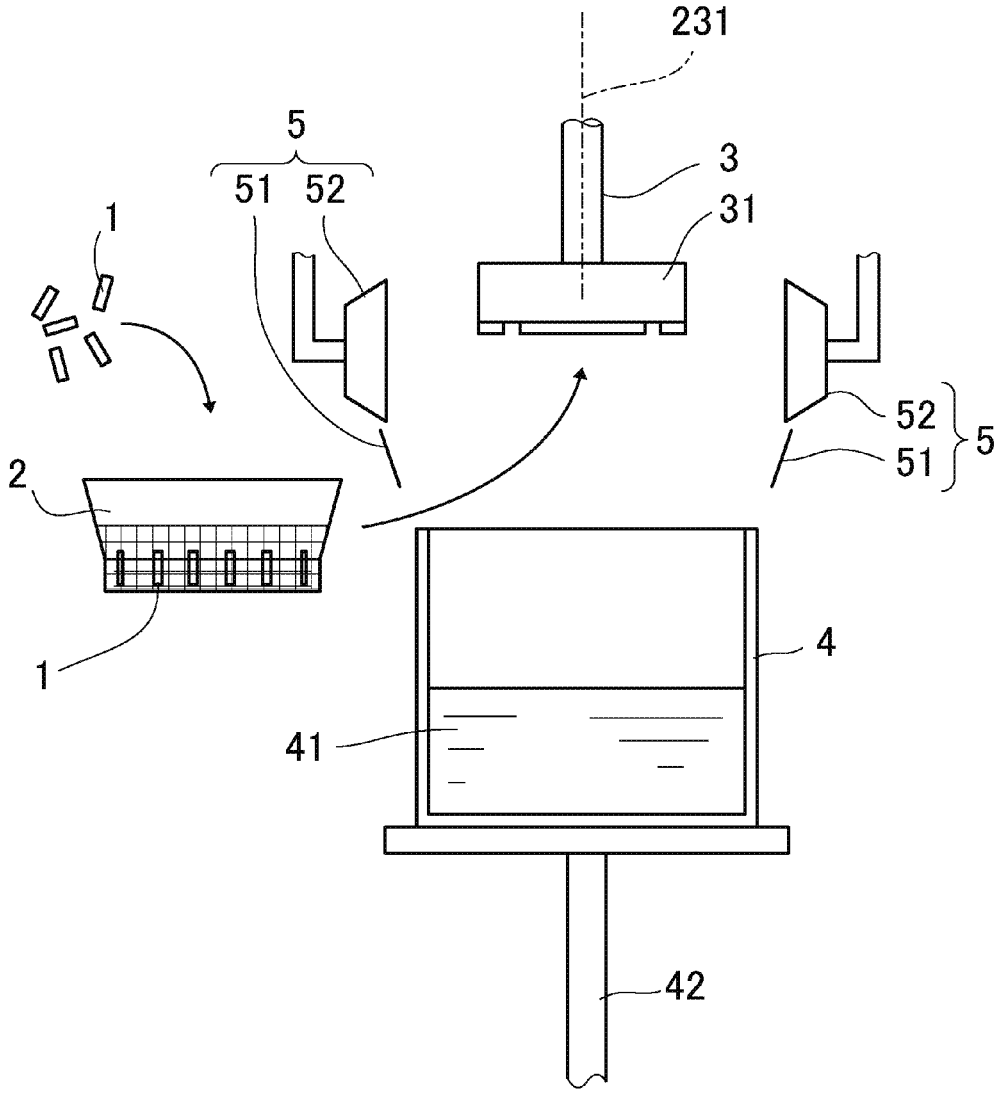

At the time of applying a powder containing at least one selected from an oxide, a fluoride, an oxyfluoride, a hydroxide or a hydride of $R^2$ ($R^2$ is at least one selected from rare-earth elements including Y and Sc) (rare-earth-compound powder) to the surfaces of the sintered magnet bodies 1 by use of this application device, as depicted in FIG. 1, first, the slurry 41 obtained by dissolving the powder in a solvent is contained in the slurry tank 4, the slurry tank 4 is filled with the slurry 41 up to an intermediate portion in the height direction of the slurry tank 4, and, simultaneously, a predetermined space where the slurry 41 is absent is secured at an upper portion inside the slurry tank 4.

On the other hand, as depicted in FIG. 1, the sintered magnet body 1 is inserted and held in each holding pocket 228 provided in the object holding body 22 (see FIG. 6) in the jig 2, whereby the plurality of sintered magnet bodies 1 are disposed in a circular pattern around the rotational axis 231 and are held to be erect with the thickness direction T thereof set horizontal and with the width direction W (233) thereof inclined at the predetermined angle r from the direction 232 of the centrifugal force, as depicted in FIGS. 6 to 8. The jig 2 is mounted to the chuck section 31 of the rotating means 3, and is set on the upper side of the slurry tank 4.

In this condition, the slurry tank 4 is lifted up to an uppermost stage by the lift (lifting means) 42, whereby the sintered magnet bodies 1 held in the jig 2 are immersed in the slurry 41 in the slurry tank 4, as depicted in FIG. 2, and the slurry 41 is applied to the sintered magnet bodies 1. In this instance, though not particularly limited, the jig 2 may be rotated normally and reversely at a low speed of approximately 5 to 20 rpm by the rotating means 3, whereby the slurry 41 can be favorably distributed and applied to the whole surface of each of the sintered magnet bodies 1 held in the holding pockets 228 of the object holding body 22.

Next, as depicted in FIG. 3, the slurry tank 4 is lowered to an intermediate stage by the lift (lifting means) 42, whereby the sintered magnet bodies 1 are drawn up from the slurry 41, and are held at an upper portion inside the slurry tank 4. In this condition, the jig 2 is rotated normally and reversely at a high speed by the rotating means 3, whereby surplus slurry present on the surfaces of the sintered magnet bodies 1 are removed by the centrifugal force. The surplus slurry thus removed is returned to a slurry reservoir in the slurry tank 4.

In this instance, the rotational speed of the jig 2 is appropriately set at such a rotational speed as to enable favorable removal of residual slurry drops, according to the concentration of the slurry 41, the shape and size of the sintered magnet body 1, and the number of the sintered magnet bodies 1, and is not particularly limited. Normally, the rotational speed is set at a rotational speed of 170 to 550 rpm such that a centrifugal force of 5 to 50 G is exerted on each of the sintered magnet bodies 1. By such a setting, collection of the liquid on the surfaces of the sintered magnet bodies 1 can be avoided, and a coating amount can be made uniform.

After the removal of the surplus slurry is conducted, the slurry tank 4 is further lowered to a lowermost position by the lift (lifting means) 42, as depicted in FIG. 4, whereby the jig 2 is taken out completely upward from the slurry tank 4. In this condition, the sintered magnet bodies 1 are dried by the drying means 5, to remove the solvent in the slurry applied to the surfaces of the sintered magnet bodies 1 and to cause the powder to be applied to the surfaces of the sintered magnet bodies 1, thereby forming coating films of the powder on the surfaces. In this instance, the drying may be conducted while rotating at a low speed (approximately 5 to 20 rpm) by the rotating means 3, and the rotation may be conducted either in one direction or in both normal and reverse directions.

After the drying, the jig 2 is detached from the rotating means 3, as depicted in FIG. 5, and the sintered magnet bodies 1 coated with the powder are recovered from the jig 2. Then, in the present invention, the sintered magnet bodies are heat treated to cause the $R^2$ in the powder (the rare-earth compound) to be absorbed and diffused into the sintered magnet bodies, thereby obtaining rare-earth permanent magnets.

Here, the rare-earth-compound applying operation using the application device may be repeated multiple times to apply the rare-earth-compound powder repeatedly, whereby thicker coating films can be obtained and the uniformity of the coating films can be enhanced. The repetition of the applying operation may be conducted by repeating plural times the powder applying process from the slurry application to drying as depicted in FIGS. 2 to 4. As a result, it is possible, by repeated thin coating, to obtain a coating film with a desired thickness and to favorably control the coating amount of powder. In addition, by the repeated thin coating, it is possible to shorten the drying time and to enhance time efficiency.

In this way, according to the producing method of the present invention in which application of a rare-earth-compound powder is conducted using the application device, the sintered magnet body 1 is held and rotated in an erect state with its thickness direction T set horizontal and with its width direction W inclined at a predetermined angle r from the direction 232 of the centrifugal force, to remove the surplus slurry. As a result, the centrifugal force is exerted on the surplus slurry on the surfaces of the sintered magnet body 1 in a state in which none of the surfaces of the sintered magnet body 1 in the shape of the tetragonal plate or the tetragonal block is orthogonal to the direction 232 of the centrifugal force and all of the surfaces of the sintered magnet body 1 are inclined at the predetermined angle r without being faced perpendicularly to the centrifugal force, so that the surplus slurry on the surfaces can be removed without stagnation, and the slurry can be uniformly applied. Then, since the slurry can thus be uniformly applied and the rare-earth-compound powder can be uniformly and densely applied to the surfaces of the sintered magnet body 1, it is possible, by heat treating the sintered magnet body 1 to cause the $R^2$ in the powder (rare-earth compound) to be absorbed and diffused into the sintered magnet body 1, to efficiently produce a rare-earth magnet excellent in magnetic properties and favorably increased in coercivity.

The heat treatment for causing the rare-earth element represented by the $R^2$ to be absorbed and diffused may be performed according to a known method. In addition, if necessary, a known post-treatment such as an ageing treatment in appropriate conditions or further grinding to a shape for practical use can be conducted after the heat treatment.

Note that the application device of the present invention is not limited to the device depicted in FIGS. 1 to 8. For example, the lifting means may lift the jig 2 up and down together with the rotating means 3, instead of lifting the slurry tank 4 up and down. Further, other configurations of the jig 2, the object holding body 22, the rotating means 3, and the drying means 5 may be appropriately modified without departing from the gist of the present invention.

EXAMPLES

A more specific mode of the present invention will be described in detail below in terms of Examples, but the invention is not to be limited to Examples.

Example 1

An alloy in thin plate form was prepared by a strip casting technique, specifically by weighing Nd, Al, Fe and Cu metals having a purity of at least 99 wt %, Si having a purity of 99.99 wt %, and ferroboron, high-frequency heating in an argon atmosphere for melting, and casting the alloy melt on a copper single roll. The alloy consisted of 14.5 at % of Nd, 0.2 at % of Cu, 6.2 at % of B, 1.0 at % of Al, 1.0 at % of Si, and the balance of Fe. Hydrogen decrepitation was carried out by exposing the alloy to 0.11 MPa of hydrogen at room temperature to occlude hydrogen and then heating at 500° C. for partial dehydriding while evacuating to vacuum. The decrepitated alloy was cooled and sieved, yielding a coarse powder under 50 mesh.

The coarse powder was finely pulverized, by a jet mill using a high-pressure nitrogen gas, into a powder with a weight median particle diameter of 5 μm. The mixed fine powder thus obtained was formed under a pressure of approximately 1 ton/cm$^2$ into a block shape, while being oriented in a magnetic field of 15 kOe in a nitrogen atmosphere. The formed body was put into a sintering furnace in an Ar atmosphere, and sintered at 1,060° C. for two hours, to obtain a magnet block. The magnet block was subjected to grinding of the whole surfaces by use of a diamond cutter, followed by cleaning sequentially with an alkaline solution, pure water, nitric acid and pure water in this order and drying, to obtain a block-shaped magnet body measuring 20 mm (W)×45 mm (L)×5 mm (T: direction of giving magnetic anisotropy) similar to the one depicted in FIG. 9.

Next, a dysprosium fluoride powder was mixed with water at a mass fraction of 40%, and the powder of dysprosium fluoride was well dispersed to prepare a slurry. The slurry was applied to the magnet bodies by use of the application device depicted in FIGS. 1 to 8, and dried to cause the dysprosium fluoride powder to be applied to the magnet bodies. In this case, the inclination angle r depicted in FIG. 8 was set at 30°. This applying operation was repeated five times to form coating films of the dysprosium fluoride powder on the surfaces of the magnet bodies. Note that the applying conditions were set as follows.

Applying Conditions

Immersion time in slurry: three seconds (without rotation)

Rotating condition at the time of removal of surplus slurry: normal rotation at 400 rpm for 10 seconds, reverse rotation at 400 rpm for ten seconds; 20 seconds in total Drying: three Twin Tube transparent silica glass-made short-wavelength infrared heater units (ZKB1500/200G; output: 1,500 W, heating length: 200 mm, with cooling fan) made by Heraeus K.K. were incorporated in each of two parts; irradiation with near infrared radiation was conducted for seven seconds while rotating the jig in one direction slowly at a rotation speed of 10 rpm.

After the formation of the coating films of the dysprosium fluoride powder, the coating amount (μg/mm$^2$) was measured for a central portion and nine end portions of the magnet body as depicted in FIG. 10 by use of an X-ray fluorescent analysis thickness meter. The ratios of coating amount per unit area when the coating amount at which a coercivity increasing effect reached a peak was taken as 1.00 are set forth in Table 1.

The magnet body formed on its surfaces with the thin film of the dysprosium fluoride powder was heat treated at 900° C. in an Ar atmosphere for five hours, thereby performing an absorption treatment, and was further subjected to an ageing treatment at 500° C. for one hour, followed by rapid cooling, to obtain a rare-earth magnet. Magnet bodies measuring 2 mm×2 mm×2 mm were cut out from the central portion and the nine end portions of the magnet as depicted in FIG. 10, and the magnet bodies were each subjected to measurement of coercivity, determine an increase in coercivity. The results are set forth in Table 2.

Example 2

In the same manner as in Example 1, block-shaped magnet bodies measuring 20 mm×45 mm×5 mm (the direction of giving magnetic anisotropy) were prepared. In addition, dysprosium fluoride having an average powder particle diameter of 0.2 μm was mixed with ethanol in a mass fraction of 40%, and well dispersed to prepare a slurry, then coating films of the dysprosium fluoride powder were formed in the same manner as in Example 1, and measurement of coating amount (μg/mm$^2$) was conducted in the same manner as above. The ratios of coating amount per unit area when the coating amount at which the coercivity increasing effect reached a peak was taken as 1.00 are set forth in Table 1.

In addition, in the same manner as in Example 1, a heat treatment was conducted to perform an absorption treatment, and an ageing treatment was conducted, followed by rapid cooling, to obtain rare-earth magnets. In the same manner as in Example 1, magnet bodies were cut out, and were each subjected to measurement of coercivity, to determine an increase in coercivity. The results are set forth in Table 2.

Comparative Example 1

In the same manner as in Example 1, a block-shaped magnet measuring 20 mm×45 mm×5 mm (the direction of giving magnetic anisotropy) was prepared. In addition, dysprosium fluoride having an average powder particle diameter of 0.2 μm was mixed with ethanol in a mass fraction of 40%, and well dispersed to prepare a slurry, and application of dysprosium fluoride was conducted using the same application device as in Example 1. In this case, the removal of surplus slurry as depicted in FIG. 3 was not conducted after the slurry application, but the drying treatment depicted in FIG. 4 was directly conducted, to form a coating film of dysprosium fluoride. In other points, the same conditions as in Example 1 were adopted.

After the coating film of the dysprosium fluoride powder was formed, measurement of coating amount (μg/mm$^2$) was conducted in the same manner as in Example 1. The ratios of coating amount per unit area when the coating amount at which a coercivity increasing effect reached a peak was taken as 1.00 are set forth in Table 1. Besides, in the same manner as in Example 1, a heat treatment was conducted to perform an absorption treatment, and an ageing treatment was conducted, followed by rapid cooling in the same manner as above, to obtain rare-earth magnet. Magnet bodies were cut out in the same manner as in Example 1, and coercivity thereof was measured to determine an increase in coercivity. The results are depicted in Table 2.

Reference Example 1

Coating films of dysprosium fluoride were formed on sintered magnet bodies in the same manner as in Example 1, except that the rotating condition at the time of removal of surplus slurry was normal rotation at 50 rpm for ten seconds, reverse rotation at 50 rpm for ten seconds, with a total rotation time being 20 seconds, and the coating amount (μg/mm$^2$) was measured in the same manner as above. The ratios of coating amount per unit area when the coating amount at which the coercivity increasing effect reached a peak was taken as 1.00 are set forth in Table 1. Besides, in the same manner as in Example 1, a heat treatment was conducted to perform an absorption treatment, and an ageing treatment was conducted, followed by rapid cooling in the same manner as above, to obtain rare-earth magnet. Magnet bodies were cut out in the same manner as in Example 1, and coercivity thereof was measured to determine an increase in coercivity. The results are depicted in Table 2.

TABLE 1

| | Ratios of coating amount on measurement point basis | | | | | | | | |
|---|---|---|---|---|---|---|---|---|---|
| | 1 | 2 | 3 | 4 | 5 | 6 | 7 | 8 | 9 |
| Example 1 | 1.03 | 1.01 | 1.00 | 1.05 | 1.05 | 1.03 | 1.04 | 1.04 | 1.04 |
| Example 2 | 1.00 | 1.01 | 0.98 | 0.99 | 0.99 | 1.05 | 1.01 | 1.02 | 1.01 |
| Comparative Example 1 | 1.38 | 1.15 | 0.99 | 0.92 | 1.01 | 1.09 | 1.26 | 1.45 | 1.59 |
| Reference Example 1 | 1.25 | 1.13 | 1.11 | 1.22 | 1.18 | 1.23 | 1.13 | 1.25 | 1.12 |

TABLE 2

| | Increase in coercivity (unit: kA/m) | | | | | | | | |
|---|---|---|---|---|---|---|---|---|---|
| | 1 | 2 | 3 | 4 | 5 | 6 | 7 | 8 | 9 |
| Example 1 | 480 | 475 | 460 | 480 | 480 | 470 | 480 | 480 | 480 |
| Example 2 | 470 | 470 | 460 | 460 | 470 | 470 | 475 | 470 | 475 |
| Comparative Example 1 | 485 | 480 | 455 | 450 | 465 | 470 | 470 | 480 | 485 |
| Reference Example 1 | 480 | 475 | 460 | 470 | 470 | 470 | 470 | 480 | 470 |

In Examples 1 and 2, variability in coating amount was small, and an in-plane coercivity increasing effect was very uniform and stable. On the other hand, in Comparative Example 1 in which removal of surplus slurry by high-speed rotation was not conducted, the residual droplets were dried as they were, and, as a result, variability in coating amount was very large. Variability in increase in coercivity was large as compared to Examples. Besides, in Reference Example 1 in which the rotational speed at the time of removal of surplus slurry was slow and did not reach a high-speed rotation region, also, uniformity in coating amount and increase in coercivity was rather poor.

Examples 3 and 4, Comparative Example 2, and Reference Example 2

Coating films of dysprosium fluoride were formed on sintered magnet bodies in the same manner as in Example 1, except that the inclination angle r depicted in FIG. 8 was changed as depicted below, and the coating amount (μg/mm$^2$) was measured in the same manner as above. The ratios of coating amount per unit area when the coating amount at which the coercivity increasing effect reached a peak was taken as 1.00 are set forth in Table 3.

(Inclination Angle r)

Example 3: 15°
Example 4: 30°
Comparative Example 2: 0°
Reference Example 2: 45°

TABLE 3

| | Ratios of coating amount on measurement point basis | | | | | | | | |
|---|---|---|---|---|---|---|---|---|---|
| | 1 | 2 | 3 | 4 | 5 | 6 | 7 | 8 | 9 |
| Example 3 | 1.04 | 1.02 | 1.06 | 1.01 | 1.02 | 1.02 | 1.02 | 1.03 | 1.03 |
| Example 4 | 1.09 | 1.05 | 1.08 | 1.02 | 1.04 | 1.03 | 1.03 | 1.04 | 1.04 |
| Comparative Example 2 | 1.11 | 1.16 | 1.05 | 1.12 | 1.09 | 1.19 | 1.13 | 1.14 | 1.21 |
| Reference Example 2 | 1.33 | 1.26 | 1.11 | 1.22 | 1.16 | 1.13 | 1.16 | 1.25 | 1.31 |

As seen from Table 3, in Comparative Example 2 in which the inclination angle r was 0°, removal of surplus slurry was conducted in a state in which two flat surfaces of the sintered magnet body were orthogonal to the direction of the centrifugal force, and, as a result, uniformity of the coating film was lowered. Besides, in Reference Example 2 in which the inclination angle r was at least 45°, also, enhancement of uniformity of the coating film was observed but the enhancing effect was slightly inferior as compared to Examples 3 and 4.

REFERENCE SIGNS LIST

1 sintered magnet body
2 jig
21 basket
22 object holding body
221 rack
222 upper-stage sheet
223 lower-stage sheet
225 prop
226, 227 through-hole
228 holding pocket
231 rotational axis (rotational center)
232 direction of centrifugal force
233 formation direction of holding pockets (width direction of sintered magnet body)
3 rotating means
31 chuck section
4 slurry tank
41 slurry
42 lift (lifting means)
5 drying means
51 heater
52 exhaust hood
r inclination angle
T thickness direction
L length direction
W width direction

The invention claimed is:

1. A method for producing a rare-earth magnet, in a process of applying a slurry obtained by dispersing a powder containing at least one selected from an oxide, a fluoride, an oxyfluoride, a hydroxide or a hydride of $R^2$ ($R^2$ is at least one rare-earth element) in a solvent to a sintered magnet body composed of a $R^1$—Fe—B composition ($R^1$ is at least one rare-earth element), drying the slurry to cause a surface of the sintered magnet body to be coated with the powder, and heat treating the powder-coated sintered magnet body to cause the $R^2$ to be absorbed into the sintered magnet body and thereby to produce a rare-earth permanent magnet, the method comprising:

holding a plurality of the sintered magnet bodies by a rotatable jig;

immersing the sintered magnet bodies in the slurry obtained by dispersing the powder to coat each of the sintered magnet bodies with the slurry;

drawing the slurry-coated sintered magnet bodies up from the slurry;

rotating the sintered magnet bodies together with the jig to remove surplus slurry on the surface of each of the sintered magnet bodies by a centrifugal force, wherein the sintered magnet bodies are disposed around a rotational axis of the jig and are inclined such that no part of any of outer surfaces constituting shapes of the sintered magnet bodies is orthogonal to the direction of the centrifugal force acting on each of the sintered magnet bodies; and drying the slurry-coated sintered magnet bodies to coat the surfaces of the sintered magnet bodies with the powder, wherein each of the sintered magnet bodies has a shape selected from a group consisting of a tetragonal plate shape, a tetragonal block shape, and a semicircular shape.

2. The method for producing the rare-earth magnet according to claim 1, wherein the sintered magnet bodies are in a shape of a tetragonal plate or a tetragonal block, and each of the sintered magnet bodies is held by the jig in a state in which the sintered magnet body is erect with its thickness direction set horizontal and with its length direction or width direction inclined at an angle of more than 0° and less than 45° from the direction of the centrifugal force.

3. The method for producing the rare-earth magnet according to claim 1 or 2, wherein the application process of immersing the sintered magnet bodies in the slurry, removing the surplus slurry and drying the slurry-coated sintered magnet bodies is repeated multiple times.

4. The method for producing the rare-earth magnet according to claim 1, wherein the jig is rotated normally and reversely at a low speed of 5 to 20 rpm in a state in which the sintered magnet bodies are immersed in the slurry, thereby to apply the slurry to the sintered magnet bodies.

5. The method for producing the rare-earth magnet according to claim 1, wherein the jig is drawn up from the slurry and rotated normally and reversely at a high speed of 170 to 550 rpm, thereby to remove the surplus slurry present on the surfaces of the sintered magnet bodies.

6. The method for producing the rare-earth magnet according to claim 1, wherein the sintered magnet body coated with the powder is heat treated in vacuum or an inert gas at temperature of up to sintering temperature of the sintered magnet body.

7. The method for producing the rare-earth magnet according to claim 1, wherein after the heat treatment, the sintered magnet body coated with the powder is subjected further to an ageing treatment at a temperature lower than a temperature of the heat treatment.

* * * * *